US012151135B2

(12) United States Patent
Premachandra et al.

(10) Patent No.: US 12,151,135 B2
(45) Date of Patent: Nov. 26, 2024

(54) ELECTRIC MOTOR BASED PHYSICAL TRAINING TECHNOLOGY AND DEVICES

(71) Applicant: Thorux Corp., Aliso Viejo, CA (US)

(72) Inventors: Ranjith Premachandra, Woodland Hills, CA (US); Fazel Farahmand, Aliso Viejo, CA (US); Amir Damansouz, Mission Viejo, CA (US)

(73) Assignee: Thorux Corp., Woodland Hills, CA (US)

( * ) Notice: Subject to any disclaimer, the term of this patent is extended or adjusted under 35 U.S.C. 154(b) by 417 days.

(21) Appl. No.: 17/345,140

(22) Filed: Jun. 11, 2021

(65) Prior Publication Data

US 2021/0387038 A1 Dec. 16, 2021

Related U.S. Application Data

(60) Provisional application No. 63/038,523, filed on Jun. 12, 2020.

(51) Int. Cl.

| | |
|---|---|
| ***A63B 24/00*** | (2006.01) |
| ***A63B 21/00*** | (2006.01) |
| ***A63B 21/005*** | (2006.01) |
| ***A63B 21/055*** | (2006.01) |
| ***A63B 71/06*** | (2006.01) |
| *A63B 22/00* | (2006.01) |
| *A63B 71/00* | (2006.01) |

(52) U.S. Cl.

CPC ..... *A63B 21/0058* (2013.01); *A63B 21/154* (2013.01); *A63B 21/4029* (2015.10); *A63B 24/0087* (2013.01); *A63B 71/0622* (2013.01); *A63B 22/0056* (2013.01); *A63B 2071/0072* (2013.01); *A63B 2071/065* (2013.01); *A63B 2220/12* (2013.01); *A63B 2220/56* (2013.01)

(58) Field of Classification Search

CPC . A63B 21/0058; A63B 22/0002; A63B 23/12; A63B 22/0048; A63B 21/005; A63B 21/4029; A63B 21/078

See application file for complete search history.

(56) References Cited

U.S. PATENT DOCUMENTS 5,020,794 A 6/1991 Englehardt et al.
5,117,170 A 5/1992 Keane et al.
(Continued)

FOREIGN PATENT DOCUMENTS

CN 108136249 B * 5/2020 ..... A63B 17/04

OTHER PUBLICATIONS

English Translation of Bai CN108136249B (Year: 2020).*

*Primary Examiner* — Joshua T Kennedy
(74) *Attorney, Agent, or Firm* — Makoui Law, PC; Ali Makoui

(57) ABSTRACT

Techniques for strength training using an exercise system including an electric linear motor. The exercise system includes a stand, including the electric linear motor comprising a mover and a rotor, and a user interface. The exercise system further includes an exercise attachment coupled to the mover in the electric linear motor, and a controller configured to control force generated by the electric linear motor, where an amount of force required to move the exercise attachment changes based on the force generated by the electric linear motor, and configured to display information related to moving the exercise attachment.

19 Claims, 14 Drawing Sheets

(56) References Cited

U.S. PATENT DOCUMENTS

| | | | | |
|---|---|---|---|---|
| 6,368,251 | B1 | 4/2002 | Casler et al. | |
| 7,223,215 | B2 | 5/2007 | Bastyr | |
| 8,475,338 | B2 * | 7/2013 | Greenhill | A63B 21/0058 482/901 |
| 9,586,091 | B2 | 3/2017 | Reich et al. | |
| 9,724,563 | B2 | 8/2017 | Schmidt | |
| 9,833,662 | B2 | 12/2017 | Potter et al. | |
| 10,569,125 | B2 | 2/2020 | Schindler-Ivens et al. | |
| 10,589,163 | B2 | 3/2020 | Orady et al. | |
| 2009/0009110 | A1 | 1/2009 | Wang | |
| 2014/0194251 | A1 | 7/2014 | Reich et al. | |
| 2018/0021614 | A1 | 1/2018 | Taft et al. | |
| 2018/0228682 | A1 | 8/2018 | Bayerlein et al. | |
| 2019/0111318 | A1 | 4/2019 | Evancha et al. | |
| 2019/0151716 | A1 | 5/2019 | Bird | |
| 2019/0160324 | A1 | 5/2019 | Leopoldo Da Camara Filho | |
| 2019/0209892 | A1 | 7/2019 | Miller et al. | |
| 2019/0217145 | A1 | 7/2019 | Durket | |
| 2020/0070005 | A1 * | 3/2020 | Lin | A63B 24/0087 |
| 2020/0139187 | A1 * | 5/2020 | Kennington | A63B 71/0622 |
| 2020/0376318 | A1 * | 12/2020 | Durket | A63B 23/0405 |

* cited by examiner

ELECTRIC MOTOR BASED PHYSICAL TRAINING TECHNOLOGY AND DEVICES

CROSS-REFERENCE TO RELATED APPLICATIONS

This application claims priority to and the benefit of U.S. Provisional Patent Application No. 63/038,523, filed Jun. 12, 2020, which is incorporated by reference in its entirety.

BACKGROUND

Strength training and exercise systems (e.g., machines used at personal and commercial gymnasiums or physical therapy centers) use a variety of simple mechanisms to provide resistance to users. For example, exercise machines typically use free weights, pulley systems with weights, resistance bands, or springs, to provide the resistance required to allow a user to exercise or train. Further, exercise machines can include simple computer controlled safety systems to protect the user.

SUMMARY

Embodiments include an exercise system. The exercise system includes a stand, including an electric linear motor that includes a mover and a rotor, and a user interface. The exercise system further includes an exercise attachment coupled to the mover in the electric linear motor. The exercise system further includes a controller configured to perform one or more operations. The operations include controlling force generated by the electric linear motor. An amount of force required to move the exercise attachment changes based on the force generated by the electric linear motor. The operations further include displaying, on the user interface, information related to moving the exercise attachment.

Embodiments further include a further exercise system. The exercise system includes a stand, including an electric linear motor that includes a mover and a rotor, and a user interface. The exercise system further includes an attachment point for a rope or cable, the attachment point coupled to the mover in the electric linear motor. The exercise system further includes a pulley configured to guide the rope or cable, the pulley coupled to the stand using a vertically movable member. The exercise system further includes a controller configured to perform one or more operations. The operations include controlling force generated by the electric linear motor. An amount of force required to move the rope or cable changes based on the force generated by the electric linear motor.

Embodiments further include a method. The method includes controlling, using a computer processor, force generated by an electric linear motor coupled to an exercise equipment. This includes increasing the force generated by the electric linear motor to increase resistance relating to a first exercise performed using the exercise equipment, and decreasing the force generated by the electric linear motor to decrease resistance relating to a second exercise performed using the exercise equipment. The method further includes displaying, using the computer processor on a user interface associated with the exercise equipment, information relating to the force generated by the electric linear motor.

BRIEF DESCRIPTION OF THE DRAWINGS

The disclosure will be understood more fully from the detailed description given below and from the accompanying figures of examples described herein. The figures are used to provide knowledge and understanding of examples described herein and do not limit the scope of the disclosure to these specific examples. Furthermore, the figures are not necessarily drawn to scale.

To facilitate understanding, identical reference numerals have been used, where possible, to designate identical elements that are common to the figures. It is contemplated that elements disclosed in one embodiment may be beneficially used in other embodiments without specific recitation.

DETAILED DESCRIPTION

Figure 1:
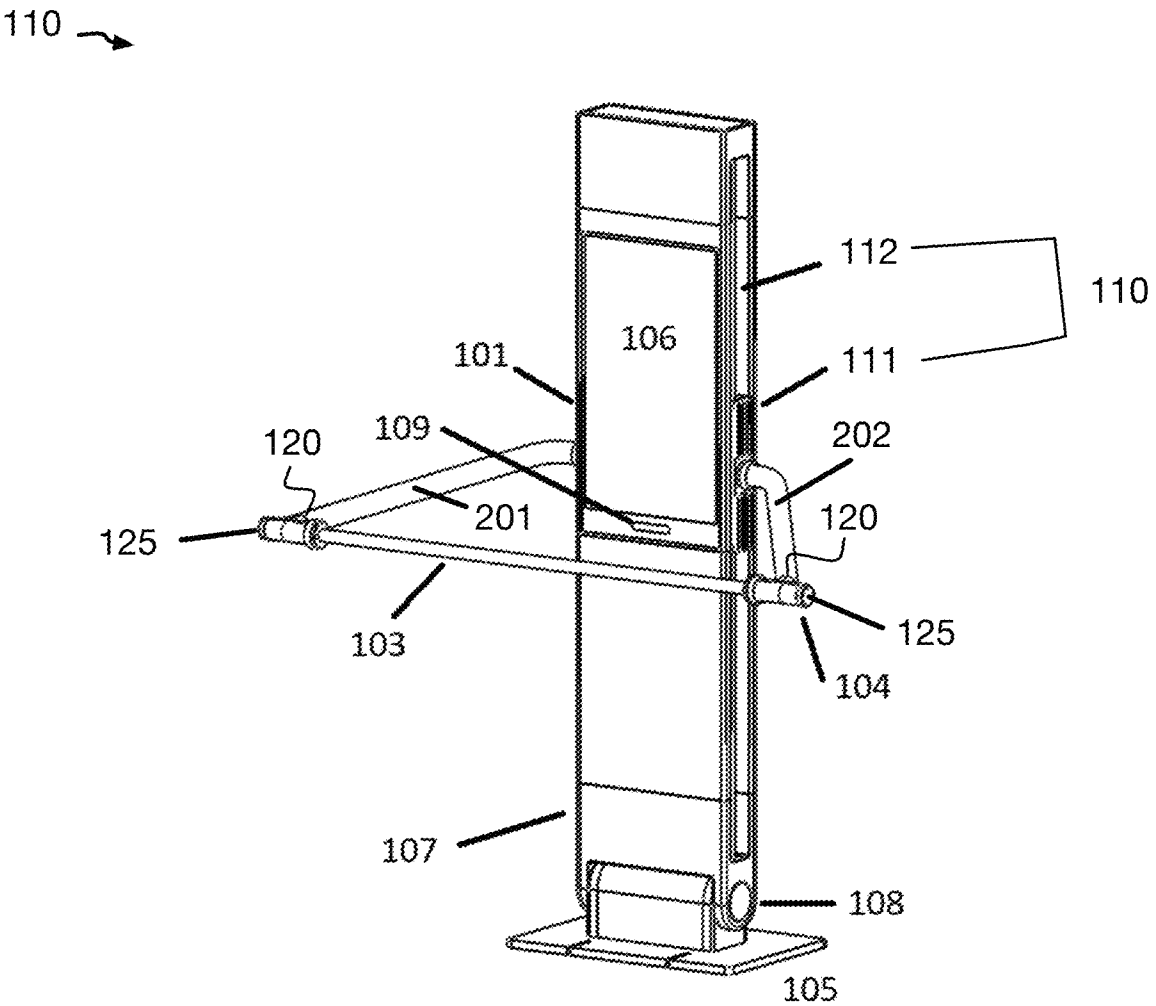
FIG. 1 illustrates a strength training system using electric motors, according to one embodiment.

Conventional strength training and exercise systems have numerous drawbacks. For example, many strength training systems require a user to manually add, or remove, weights to operate the system and change resistance. A user must add weight to increase resistance and must remove weight to decrease resistance. But to do this, the user must stop using the equipment to find the needed weights, then change the weights or resistance in order to continue with the workout.

These conventional strength training systems in which a user must manually add, or remove, weights, can lead to a variety of drawbacks. As one example, manually changing weights can waste a significant amount of time, leading to a much longer workout for the user. This is detrimental to the user, because it wastes the user's time and can lead to fatigue from searching for scattered weights, mounting them, and securing them. It is also detrimental to commercial gyms, because it can result in a lower throughput per each training system, and ultimately a lower throughput for the entire gym. For a commercial gym, this can increase expenses and decrease profits—the commercial gym may need additional equipment or space, or may not be able to service as many customers at once.

Conventional strength training systems in which a user must manually add, or remove, weights, can further give rise to safety concerns. For example, a user could injure him or herself by dropping weights while re-racking or working out. This can lead to injuries both to the user, and to bystanders. Further, injuries may be caused by fatigued users who are unable to quickly and safely unload weights off the equipment and make the equipment stop in place, resulting in the weights falling on themselves or others. Other common injuries include accidentally wedging a hand, a foot or other body parts in-between the moving parts of a machine or between the weights. Various long-term and short-term injuries are further caused due to improper form, or may be sustained during re-racking of the weights. To avoid these injuries, users may be forced to find a spotter or a partner to assist in the exercise, and may never reach the full exercise potential due to fear of dropping weights or losing control of the weights.

Conventional strength training systems can further lead to injuries among employees in commercial gyms. For example, employees may be injured during their daily routines such as by re-racking large weights, by carrying large displaced weights around, by servicing the equipment, etc. The potential of such injuries typically causes a variety of issues for the commercial gyms and sport centers including dramatic increase in insurance rates, lost revenue, personal injury lawsuits, and higher capital expenditures for safety systems. In addition, having conventional exercise equipment requires additional employees to better maintain the gyms due to the need for re-racking the weights, moving the equipment around, servicing the equipment, diagnosing problems with the equipment, etc. These issues ultimately result in higher operating expenses and thus higher membership costs.

Another disadvantage of a conventional strength training equipment is its size and weight. A typical free weight system would require a bench, a barbell, or a dumbbell capable of fitting a specific set of weights. In most instances each system would require multiple sets of weights (e.g., 2 or 4 sets of 45 lbs. weights, 2 sets of 35 lbs. weights, etc.) or several sets of dumbbells. As a result, these systems take up a large amount of floor space and are not very portable.

Further, the user of such a system may be unable to quickly change the weight or resistance of the device, or may not be able to change the weight or resistance of the device in small increments (e.g., the user may be unable to increment the weight by 1 lb. when the bar is at its resting position). The user may be unable to customize the increment or decrement of the weight based on a preset routine (e.g., increment the weight by 0.5 lb. each repetition, when the bar is at its resting position). As discussed further below, this can be particularly problematic in a physical therapy setting where precision can be crucial.

Conventional belt, or pulley-based systems (e.g., as opposed to free weight systems discussed above) also have numerous drawbacks. Belt or pulley-based systems typically require a strong foundation due to their weight, and are not suitable for home gym type environment, especially in apartment complexes or other densely populated environments. Further, conventional rotary motor and belt or chain systems generally also take up large footprints at the gym, sometimes even more than the typical free-weight systems. In the case of a personal gym, the large size and weight of some of these equipment results in an individual opting not to purchase such systems or opting only to purchase a select few items that may fit within the available space. In the case of a commercial gym, this means less space for equipment at higher operating cost due to a larger facility requirement and a lower occupancy capacity for members.

These drawbacks in traditional strength training equipment (e.g., free-weight or belt or pulley based) may be even more problematic in a physical therapy setting. Existing physical therapy aids or physical therapy machines are often similar to traditional exercise equipment. But such systems typically lack the granularity of being able to increment or decrement by micro steps of resistance or weight. A patient or user may not be able to improve their strength by moving up or down by a fractional weight. Not having this capability generally results in more injuries, a slower patient growth and improvement curve, and a higher cost to the patient.

Further, conventional physical therapy systems are typically unable to apply resistance based on predefined points along a given motion trajectory. As an example, assume a patient has a specific bicep condition where the patient is required to do a bicep curl with a 5 lbs. weight, and ideally the 5 lbs. weight would increase to a 7.5 lbs. weight when the patient's arm is between a 45 and 90-degree angle. A conventional system would not be able to facilitate such a feature, often requiring a human physical therapist to push against the patient's arm to simulate this functionality (leaving the force imprecise and un-trackable). Further, these systems typically do not guide the user through a proper motion path to improve form, which often results in various types of injuries (e.g., especially at early stages of treatment) as well as a longer time for patient recovery. In addition, these systems generally do not record patient statistics or progress, and as such, the patient must rely on the physical therapist or administrator for such information.

Due to the lack of features mentioned above, the patients are generally required to be physically present at the therapist office to use the equipment and have the therapist guide them through specific profiles. The patients may not be able to perform parts of this training at home or remotely without a physical therapist controlling the equipment for them.

Just like for the free weight, and belt or pulley based, strength training systems discussed above, conventional training bands also come with a variety of deficiencies. Generally, these bands do not provide any benchmark of how much of actual force a user applies against the band. As a result, the training is done with little or no knowledge of patient or trainee's progress. In addition, the displacement based on the applied force may not be controlled or limited and the band may stretch indefinitely as the force increases. These bands also tend to lose resistance over usage and even change resistance based on the environment and use cycles.

One or more techniques described below can be used to solve some, or all, of these drawbacks. For example, one or more embodiments described herein relate to exercise, training, and physical therapy devices that include one or more electric motors (e.g., linear motors) to assist with strength training. For example, a mover component in the motors can travel along a shaft while applying a set force that a user may push or pull against, to simulate a strength or endurance training device.

In an embodiment, motors may provide a resistance similar to a free weight or a resistance band based system. The user can to pull or push against the force of the motors using a mechanical coupling scheme, for example, and one or more levers. As described further below this can be done with systems including electric motors (e.g., linear, rotary, or a combination), intelligent highly configurable control systems, efficient power delivery systems, next generation user interfaces, and high accuracy sensors. Strength training systems using these techniques provide improved safety, flexibility, and performance, while enhancing the overall user experience.

In an embodiment, one or more strength training systems described below may simulate many conventional strength and endurance training systems (e.g., using linear or other electric motors). For example, strength training systems can include electric motor drive modules, which may include a power stage and a control stage, and which may be mounted in various locations including, but not limited to, the motor itself, a stand, as a standalone enclosure, or in any other suitable location. This can be used to simulate conventional systems, including barbells, cable and pulley systems, bench press systems, rowing machines, leg press/squat systems, etc.

In addition to being a simple one-degree-of-freedom force translation mechanism, some embodiments provide the ability of adding degrees of freedom (including translational and rotational), as well as changing the direction of the degrees of freedom (e.g., and without limitations, by using pivot points or motor controlled joints). Unlike conventional systems, one or more embodiments described below are smaller in weight and footprint than conventional systems, and eliminate the need for traditional bulky workout equipment (e.g., through the user of linear motors or other electric motors) and make the system far safer and more compact than traditional strength training equipment.

FIG. 1 illustrates a strength training system 100 using electric motors, according to one embodiment. In an embodiment, the system 100 includes two electric linear motors 110 and a horizontal bar 103. Each linear motor 110 includes a mover 111 (e.g., a moving component) and a rotor 112 (e.g., a static component). For example, the mover 111 can travel up and down the rotor 112 (e.g., a motor shaft) on its respective side and can generate force in either direction of travel. This allows the linear motors 110 to generate force in either desired direction (e.g., with the mover 111 traveling up or down the rotor 112) based on the selected workout criteria. In an embodiment, the horizontal bar 103 is a unitary bar and the two linear motors 110 (e.g., the respective movers 111) move together. Alternatively, the horizontal bar 103 can be made up of multiple pieces (e.g., the two bars 201 and 202), allowing for the two linear motors 110 to move independently.

In an embodiment, the two linear motors 110 (e.g., the mover 111 and the rotor 112) are supported in place by a stationary base 105. The system 100 further includes two free-weight holders (e.g., free-weight mounts) 104 at the ends of the horizontal bar 103. In an embodiment the free weight holders 104 allow the user to add free weights to help the linear motors 110 reach higher loads, if desired. In addition, the free-weight holders 104 can also be used to mount free-weights to allow the system 100 to be used without electricity (e.g., in the event of a power outage or to conserve energy). This is merely an embodiment, and the system 100 could exclude the free weight holders 104, could include more (or fewer) free weight mounts, or could include any other suitable configuration.

As discussed above, in an embodiment the linear motors 110 each include a moving component 111, which are referred to as movers. The linear motors 110 further each include a static component 112, which are referred to as rotors. In an embodiment, as illustrated in FIG. 1, the rotor 112 is in a shaft or tubular form, and the mover 111 encloses the shaft. For example, this enclosure can serve as a safety feature to avoid items being caught in, or struck by, the mover 111. However, the rotor 112 may take any other appropriate form. For example, the rotor 112 may be a plate, which the mover 111 may or may not enclose. As another example, the rotor 112 may take the form of a U shaped extrusion, which encloses (partially or fully) the mover 111.

In an embodiment, windings for the linear motors 110 are in the respective mover 111. Alternatively, or in addition, the windings for the linear motors 110 may be located in the respective rotor 112, or in both the respective mover 111 and rotor 112.

As illustrated in FIG. 1, in an embodiment the system 100 includes two linear motors 110 on each side of a stand 107. Alternatively, the system 100 may include only a single linear motor 110, which may be located in the center of the stand 107 or in any other suitable location. For example, this embodiment could include two attachment points for the connection of an exercise attachment, such as horizontal bar 103, to the linear motor or motors. This is discussed further below with regard to FIG. 2. Further, in an embodiment the stand 107 can include a pivot joint 108. This is discussed further below with regard to FIG. 5.

The system 100 further includes a user interface 106 attached to the stand 107. In an embodiment, the stand 107 is directly attached to the base 105. Alternatively, the stand 107 is not directly attached to the base 105. The user interface 106 can be any suitable user interface, including a display, a touch sensitive interface, a voice activated interface, a visually activated interface, an interface controlled using another device (e.g., a smartphone or remote control), or any other suitable interface. In an embodiment, the user interface 106 is used to control the force of the linear motors 110. Further, the user interface 106 can display various information related to moving the bar 103. This can include metrics for a user (e.g., calorie count, heart rate, number of reps, or any other suitable metric), force generated by the electric motors 110, or any other suitable information. The user interface 106 may also enable the user to load and select various workout profiles and select interchangeable functions of the system.

In an embodiment, the system 100 includes an interface area 109 that includes interface devices such as cameras, microphones, buttons, and speakers. In an embodiment the interface area 109 can be included in the stand 107, the user interface 106, or in any other suitable location. For example, the interface area 109 can include 3D depth sensing cameras to detect the location of the user or equipment (e.g., a bench or exercise attachment, as discussed further below with regard to subsequent figures). For example, the interface area 109 can include multiple cameras acting as stereo cameras. The cameras can be used to generate a contour map (e.g., an Intel® RealSense™ camera). As another example, the interface area 109 can include high resolution cameras, which the user can use to record and stream video.

In an embodiment, the interface area 109 can further include one or more microphones. The microphones can be used to detect safe words or commands by the user, such as commands to stop or start the linear motors 110, to increase or decrease the force generated by the linear motors 110, to change the speed or position of the linear motors 110, to change the exercise routine, to program a computing system (e.g., in the system 100), to increase or decrease volume (e.g., from speakers included in the interface area 109), to provide commands to third party software or devices (e.g.

Google Home™, Amazon Alexa™, etc.). The interface area 109 may further include buttons. The buttons may be mechanical, capacitive or resistive, or use any other suitable interface techniques. Further, the buttons may be used to stop or start the linear motors 110, to increase or decrease the force generated by the linear motors 110, to change the speed or position of the linear motors 110, to change the exercise routine, to program a computing system (e.g., in the system 100), to increase or decrease volume (e.g., from speakers included in the interface area 109), to provide commands to third party software or devices (e.g. Google Home™, Amazon Alexa™, etc.).

The operations of the motors 110 and the user interface 106 may be controlled by a controller, which may include a processor and memory. Further, the system 100 can include network components suitable to connect the system 100 (e.g., the motors 110 and the user interface 106) to a communication network (e.g., the Internet, a local area network (LAN), or a wide area network (WAN)) or to a remote computing device (e.g., a user's smartphone, tablet, or computer, a remote server, or a cloud storage location). This is discussed further below with regard to FIG. 2B.

In an embodiment, the system 100 includes a controller in the same enclosure as the user interface 106, in another location in the system 100, or in a separate enclosure. The controller, in some embodiments, may optionally enable the user to connect to the system using various wired or wireless devices (e.g., smartphones, tablets, smart watches, personal fitness devices, and other suitable components) and send or receive data and commands to and from these devices remotely. The system 100 of FIG. 1 may be utilized for a variety of strength training exercise, including as a bench press system, a squat machine, a deadlift machine, or another configurable strength training machine.

In an embodiment, the linear motors 110 may be any type of linear motor that operates with a non-magnetic rotor. For example, the system 100 may use one or more linear induction motors, linear brushed DC motors, linear brushless DC motors, or linear synchronous reluctance motors. In an embodiment, linear motors that use permanent magnetic movers or rotors are typically not suitable because such magnets may cause safety issues if a user has, for example, a pacemaker. The strong magnets required of magnetic movers or rotors may also affect the operation of credit cards and cellular phones. In an embodiment, including the linear motors 110 in the system 100 (e.g., instead of rotary motors) provides numerous benefits. For example, linear motors may provide bi-directional force, whereas a rotary motor (e.g., in combination with a rope and pulley system) may only be able to provide uni-directional force.

Figure 2A:
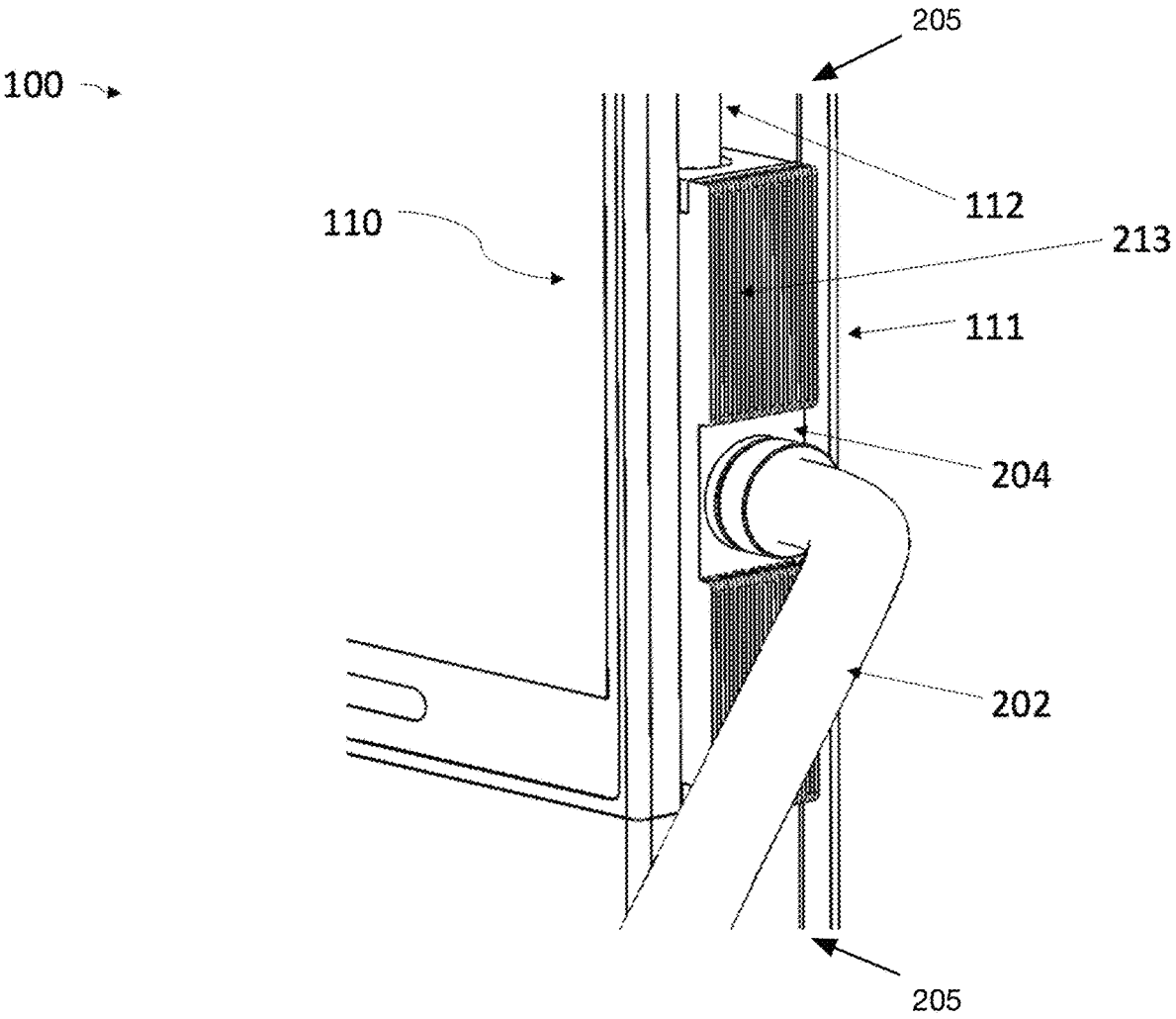
FIG. 2A further illustrates a strength training system including a linear motor, according to one embodiment.

FIG. 2A further illustrates a strength training system 100 including a linear motor, according to one embodiment. In an embodiment, the system 100 includes a linear motor 110. The linear motor 110 includes a mover 111 and a rotor 112. Further, in an embodiment, the linear motor 110 includes one or more heat dissipaters 213. The heat dissipaters 213 are merely one example, any suitable technique that increases the surface area of the linear motor 110 that is connected to (e.g., directly or indirectly) the heat-generating elements of the mover 111. In an embodiment, the heat dissipaters 213 may be metal or any other suitable material. The heat dissipaters 213 can include ridges or be configured in any other suitable manner that increases surface area.

Further, in an embodiment, the rotor 112 (e.g., a shaft) may be metal and non-magnetic, or may be non-metal. For example, in an embodiment the windings for the mover 11 interact with bare metal in the rotor 112 (e.g., a shaft). But this is merely one example. Alternatively, the mover 111, the rotor 112, or both, could be made of a non-metal material (e.g., a composite). In this example, a mover 111 (e.g., metal or non-metal) with metal windings could interact with a non-metal rotor 112 that also includes metal windings. The two sets of metal windings can interact to produce force, where one (or both) of the mover 111 and the rotor 112 are non-metal.

The system 100 further includes an exercise attachment 202 (e.g., the horizontal bar 103 illustrated in FIG. 1) In an embodiment, the exercise attachment 202 is permanently affixed to the linear motor 110. Alternatively each linear motor 110 may include an attachment point 204 on the motor. The attachment point 204 may use any suitable mechanism, such as a quick connect mechanism or a pin locking system, to ensure the attachment 202 is securely affixed to linear motor 110. The attachment point 204 may further include a button release that prevents accidental release of the attachment unless a button is pressed. Such button may be mechanical or electronic. Attachment point 204 may feature a notch or extrusion to ensure the exercise attachment 202 is affixed in relation to the linear motor at certain angle(s) or positioning(s).

In an embodiment the exercise attachment 202 (e.g., the horizontal bar 103 illustrated in FIG. 1) may include a display. For example, referring back to FIG. 1, a horizontal bar 103 include a display facing downwards and towards the stand 107 such that a user performing bench presses with the horizontal bar 103 can see the display, which could include information such as the weight or force, the number of repetitions performed, etc. The exercise attachment 202 may also (or alternatively) include LED lights or other visual indicators to provide the user with information.

In an embodiment, the exercise attachment 202 may include multiple pieces that are joined but are capable of rotating against each other upon user twisting action. Further, a sensor may be placed in the exercise attachment 202 to detect such rotation. Upon detecting rotation, the system 100 may take certain action, such as modifying the force of the linear motor 110, including varying, enabling or disabling it. Further, the exercise attachment 202 can include a designated portion (e.g., the ends of a bar) that includes dials 125 (shown in FIG. 1) or other user input mechanisms. These can be used to provide commands (e.g., increasing or decreasing the resistance).

Figure 2B:
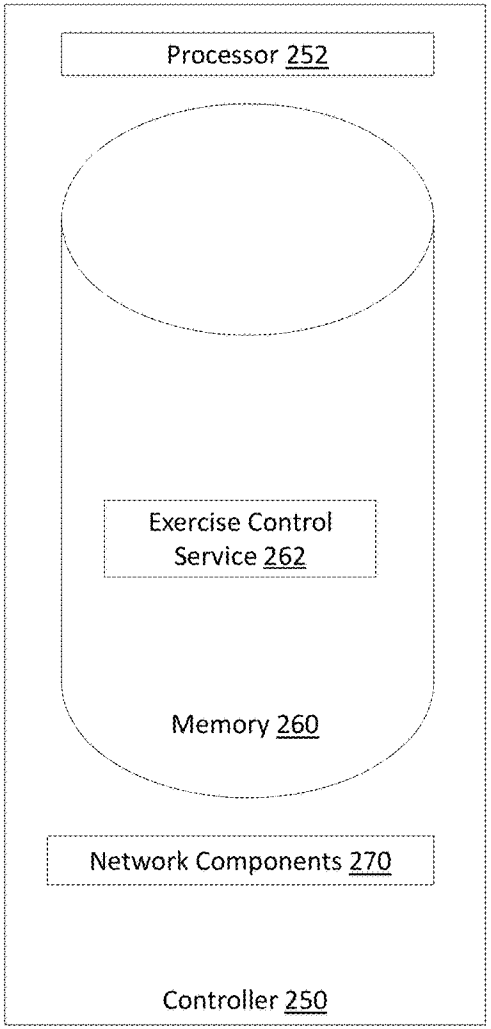
FIG. 2B illustrates a controller for a strength training system including a linear motor, according to one embodiment.

In an embodiment, the exercise attachment 202 may further include a microphone (e.g., connected to the controller 250 illustrated in FIG. 2B). The microphone, along with the controller, may be used to detect safety words (e.g. "stop") which would then stop the mover 111 or apply any brakes. Further, the exercise attachment 202 may include buttons 120 (shown in FIG. 1) connected to the controller. The buttons 120 may be mechanical, capacitive or resistive, or use any other suitable interface techniques. The buttons 120 may, for example, function to increase or decrease the force applied by the mover 111, or may function to apply a brake, or any other suitable function.

In an embodiment, the exercise attachments 202 may include the horizontal bar 103 illustrated in FIG. 1. This is merely one example, and the exercise attachment 202 can include any suitable attachment, including D-handle bars, curl bars, a straight bar, a revolving curl bar, a V-bar, a multi-exercise revolving bar, a triceps rope, a lateral bar, a revolving lateral bar, a lateral bar with stirrup handles, a vent lateral bar, a sport rower handle, a seated double row handle, or a triceps press down bar.

Further, in an embodiment, the system 100 can include two exercise attachments 202 (e.g., one for each linear motor 110 illustrated in FIG. 1). For example, the exercise attachments 202 can be placed at lower levels (e.g., by respective movers 111) so that a user may step on the attachments for use as a stepper machine. In this example, these exercise attachments each have a flat surface that are positioned at approximately shoulder width apart, or any other suitable distance. This is discussed further below with regard to FIG. 7.

The system 100 further includes a mover 111 that encloses a rotor 112 (e.g., a shaft). In an embodiment, this enclosure guides the mover 111 as it moves up and down the rotor 112. Additional or more precise guidance may be facilitated with guiderails 205 and rollers that may be mounted to the housing of the linear motor 110 or the mover 111. In an embodiment, these guiderails 205 and rollers can be used with movers 111 and rotors 112 of different configurations, including rotors 112 that are bars, plates, or U-shaped extrusions.

A mover 111 and its corresponding rotor 112 may, in an embodiment, feature one or more brakes. For example, the brakes can be used to slow or stop a mover 111 in response to user action or a controller command. A controller for the system 100 (e.g., the controller 250 illustrated in FIG. 2B) may, for example, instruct the brake to engage if it detects an unsafe condition, such as potentially unsafe (e.g., unexpected) acceleration (e.g., captured using a position sensor, as discussed further below, or using any other suitable measuring device). The brakes may, in an embodiment, be electromagnetic brakes. Alternatively, the brakes may be mechanical. For example, the mover 111 may feature clamps that may clamp a railing along a rotor 112. The brakes may be electronically or manually controlled (e.g. via hydraulics or Bowden cables). Mechanical brakes may include a fail-safe (such as a spring) that automatically engages the brakes upon a loss of electrical power.

In an embodiment, the system 100 includes position sensors to detect the location of the position of mover 111, or its relative position to the rotor 112 (e.g. a shaft or plate). The position sensors may be located on the mover 111, on the rotor 112, on the stand assembly, on any combination thereof, or in any other suitable location. Based on the information provided by the position sensors, the controller may also calculate the acceleration of the mover 111 and thus also the acceleration of the exercise attachment 202. Based on position or acceleration, the controller may adjust the position of the mover 111 or exercise attachment 202 to ensure safety, or to optimize or comply with an exercise program. For example, upon detection of potentially unsafe acceleration (e.g. 9.8 m/s2) beyond a threshold position (falling below 1.5 feet above the height bench) given the performance of a certain exercise (bench-pressing) as determined by user input or camera (e.g., included in the interface area 109 illustrated in FIG. 1), the controller may halt the position of the movers 111 to ensure a horizontal bar does not strike a person (e.g., on the head).

FIG. 2B illustrates a controller 250 for a strength training system including a linear motor, according to one embodiment. In an embodiment, the controller 250 includes a processor 252, a memory 260, and network components 270. The processor 252 generally retrieves and executes programming instructions stored in the memory 260. The processor 252 is representative of a single central processing unit (CPU), multiple CPUs, a single CPU having multiple processing cores, graphics processing units (GPUs) having multiple execution paths, and the like.

The network components 270 include the components necessary for the strength training system to interface with a communication network and remote computing devices, as discussed above in relation to FIGS. 1 and 2A. For example, the network components 270 can include wired, WiFi, Bluetooth™, or cellular network interface components and associated software. Although the memory 260 is shown as a single entity, the memory 260 may include one or more memory devices having blocks of memory associated with physical addresses, such as random access memory (RAM), read only memory (ROM), flash memory, or other types of volatile and/or non-volatile memory.

The memory 260 generally includes program code for performing various functions related to use of the controller 250. The program code is generally described as various functional "applications" or "modules" within the memory 260, although alternate implementations may have different functions and/or combinations of functions. Within the memory 260, the exercise control service 262 facilitates operation of a training system (e.g., the strength training system 100 illustrated in FIG. 1). For example, the exercise control service 262 can control movement of the linear motors 110 illustrated in FIG. 1, can control operation of the user interface 106 illustrated in FIG. 1, can control operation of the interface area 109 illustrated in FIG. 1, and can control any other suitable aspect of operation of a strength training system. As another example, the exercise control service 262 can control interaction between the strength training system and a remote communication network or remote computing devices (e.g., using the network components 270). For example, the exercise control service 262 can store, and retrieve, workout profiles and other operational information from any suitable remote location (e.g., a cloud storage location, a user's smartphone or tablet, or any other suitable location) using the network components 270.

As discussed above, in an embodiment the controller 250 includes a processor 252 and memory 260 including the exercise control service 262. Alternatively, or in addition, the controller can be configured to control a strength training system based on received commands (e.g., received from another controller, a remote device, or any other suitable location) without use of the exercise control service 262. For example, the controller 250 can receive commands to control operation of linear motors (e.g., linear motors 110 illustrated in FIG. 1), or any other suitable aspect of the strength training system, from another source (e.g., a centralized controller, a user's smartphone or computer, or another exercise device) and can implement the commands. Further, the controller 250 can be implemented using a general purpose processor, a special purpose processor, an analog system, or using any other suitable control system.

Figure 3:
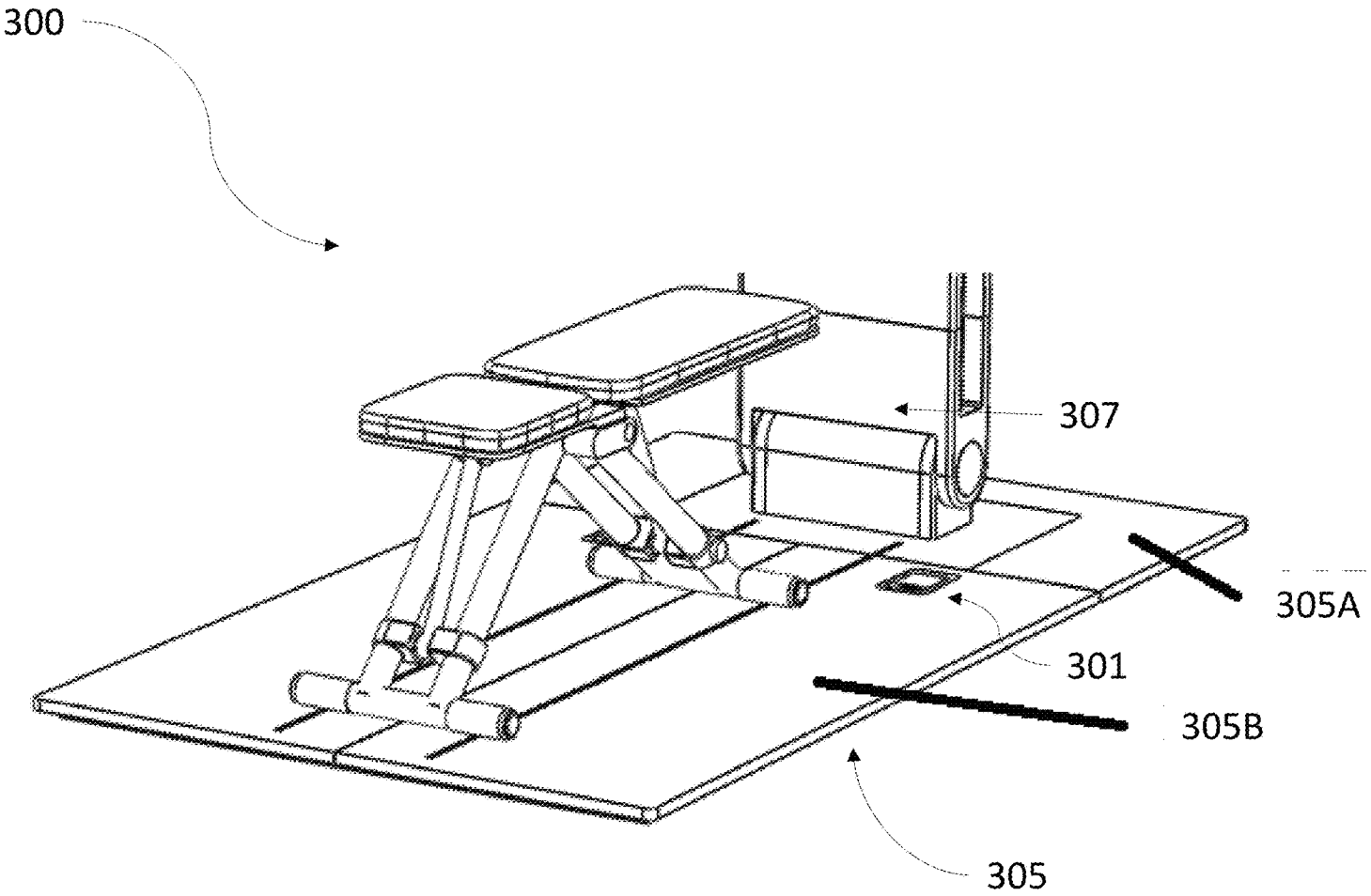
FIG. 3 illustrates a base for a strength training system, according to one embodiment.

FIG. 3 illustrates a base for a strength training system 300, according to one embodiment. In an embodiment, the strength training system 300 includes a base 305. For example, the base 305 can correspond with the base 105 illustrated in FIG. 1. As illustrated, the base includes two pieces 305A and 305B. This is merely one example, and the base 305 can be made up of one piece, two pieces, or more than two pieces. Further, each of the pieces 305A and 305B can be made up of multiple pieces. For example, as illustrated in FIG. 3, the piece 305B is itself made up of two pieces.

In an embodiment, the base pieces 305A and 305B are constructed of a rigid material. For example, the base pieces 305A and 305B can be constructed of steel, aluminum, carbon fiber, or any other suitable rigid material, to provide stability to a stand 307 (e.g., the stand 107 illustrated in FIG.

1). In an embodiment, the base pieces 305A and 305B can be constructed of a honeycombed material (e.g., with face-sheets) to increase rigidity.

The base pieces 305A and 305B may additionally feature a soft, flexible, or rubberized material on the top face to provide users with comfort. Additionally, the top face of the base 305 may be textured to provide additional traction and to prevent user slippage. Other faces of the base 305 may also be covered by material. For example, the bottom face may be covered by soft material, such as felt or rubber, to prevent the base from scratching a home's floor.

In an embodiment, when the base 305 is made up of multiple pieces (e.g., the pieces 305A and 305B), the pieces can lock together in a rigid manner that increases overall stability for the stand 307. For example, one or more of the pieces 305A and 305B may feature a latch 301 that engages the pieces to lock the pieces together. This is illustrated further with regard to FIG. 4, below. The pieces may interlock rigidly where one piece features a deep groove, and another piece features a matching protrusion. Alternatively, one of the base pieces 305A and 305B may feature a substantial lip, with another piece fitting against the lip. Alternatively, a latch 301 may engage a rigid bar across the face of the base pieces 305A and 305B (or through the base pieces 305A and 305B or at the side of the base pieces 305A and 305B) to provide rigidity across the base pieces 305A and 305B.

In an embodiment, the base 305 may further include rollers (e.g., ball bearing rollers). The rollers may, for example, be recessed within the base. Alternatively, or in addition, the rollers may be extended downwards and locked into place such that the base 305 is lifted off the ground when the system 300 needs to be moved.

Figure 4:
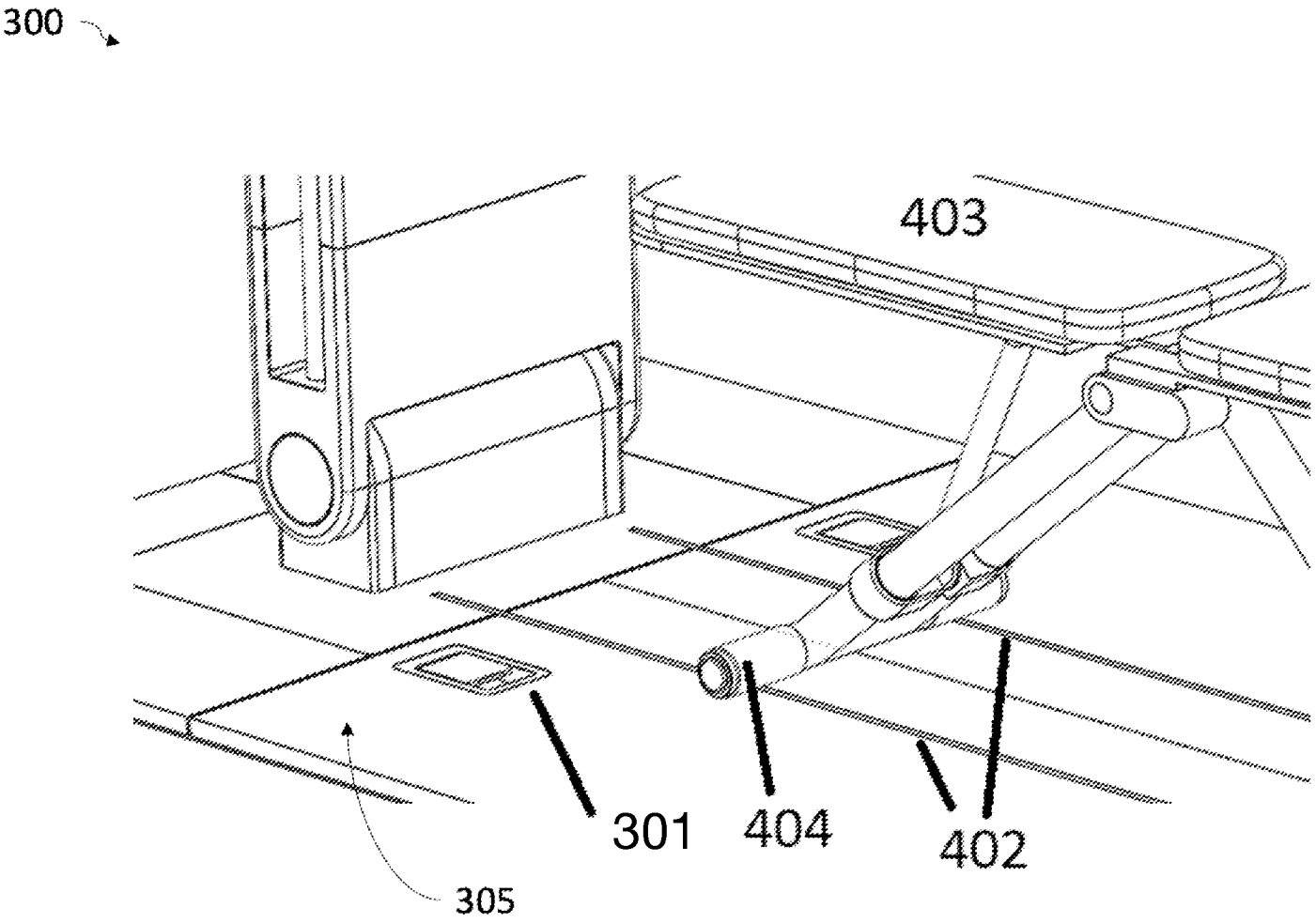
FIG. 4 illustrates a bench for a strength training system, according to one embodiment.

FIG. 4 illustrates a bench for a strength training system 300, according to one embodiment. The system 300 includes a bench 403. In an embodiment, the bench 403 is optional and may be used for suitable exercises (e.g., bench presses). For example, the bench 403 can be removable (e.g., for standing exercises). The bench 403 has one or more bench attachment points 404, which allow the bench to securely attach to a base 305 (e.g., the base 305 illustrated in FIG. 3) via base railings 402.

In an embodiment, the bench attachment point 404 may lock securely in place against a base railing 402 to prevent horizontal movement. To prevent vertical movement, bench attachment point 404 may be partially or entirely placed into base railing 402. For example, bench attachment point 404 may be T shaped and inserted into a base railing 402 groove. As another example, the bench attachment point 404 can move in the base railings 402 using rollers. The base 305 may feature one, or two, or more, base railings 402. If the base 305 is made up of multiple base pieces (e.g., base pieces 305A and 305B illustrated in FIG. 3), the base railing 402 may span only one piece. Alternatively, the base railing 402 may span multiple base pieces, as illustrated in FIG. 4. Further, in an embodiment, base railing 402, the bench attachment point 404, or both can include a latch or locking mechanism to secure the bench attachment point 404 and keep it from moving along the base railing 402 or moving off the base 305. For example, the latch or locking mechanism can include male and female components (e.g., one component on the base railing 402 and another component on the bench attachment point 404) to facilitate securing the bench attachment point 404 to the base 305 or securing the bench attachment point from moving along the base railing 402.

In an embodiment, one or more of the base 305 and the base railings 402 may include force or pressure sensors (e.g., base location sensors) distributed across their respective surface or length. Such base location sensors may include any suitable sensors, including capacitive sensors, electromagnetic sensors, piezoelectric sensors, piezoresistive sensors, strain-gauge sensors, optical sensors, potentiometric sensors, or force balancing sensors. In an embodiment base location sensors allow a controller for the system 300 (e.g., the controller 250 illustrated in FIG. 2B) to detect where a user is located, or where the bench 403 is located, with precision. For example, base location sensors may be placed on the top surface of the base 305, or base location sensors may be placed between layers of the base 305 (e.g. between a rigid layer and a softer top layer). Alternatively, or in addition, base location sensors may be placed in or on the base railings 402.

Figure 5:
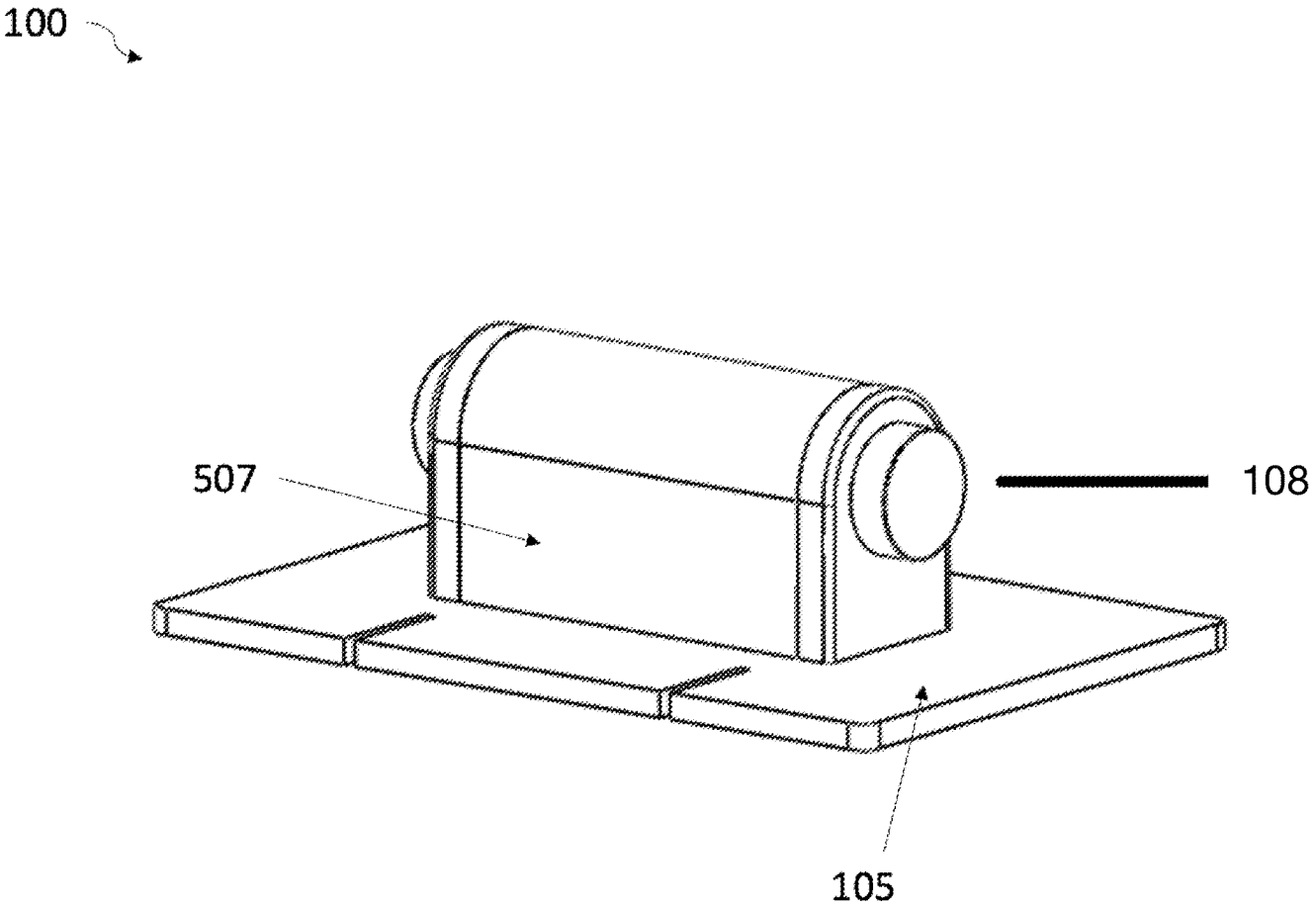
FIG. 5 illustrates a strength training system in which a stand is attached to a base using a pivot joint, according to one embodiment.

FIG. 5 illustrates a strength training system 100 in which a stand is attached to a base using a pivot joint, according to one embodiment. The system 100 includes a base 105 (e.g., the base 105 illustrated in FIG. 1), a stand (e.g., the stand 107 illustrated in FIG. 1), and a pivot joint 108. In an embodiment, the pivot joint 108 allows the stand to be tilted forward toward the user, and backward away from the user. As discussed above in relation to FIG. 1, linear motors (e.g., the linear motors 110) enable an exercise attachment (e.g., the horizontal bar 103) to provide vertical motion. In an embodiment, the pivot joint 108 provides horizontal motion. Together, the linear motors (e.g., the linear motors 110) and pivot joint 108 allows for innumerable, different motion paths.

In an embodiment, the motion of the pivot joint 508 may be passively controlled (e.g., via friction in the joint). Alternatively, the motion of the pivot joint 508 may be actively controlled (e.g., via a motor). For example, the pivot joint 508 can include an electric motor (e.g., a rotary electric motor or a mechanical electric motor), to control the motion of the pivot joint 508. For example, a cylinder in the pivot joint 508 can act as a shaft in a suitable electric motor.

In an embodiment, the interface between the pivot joint 508 and the stand may be geared (e.g., with teeth), to minimize or eliminate slippage. For example, the pivot joint 508 may be attached to the stand (e.g., the stand 107 illustrated in FIG. 1) to provide pivoting action for the device. The pivot joint housing 507 can be connected to the base 505, and the pivot joint 508 can spin (e.g., controlled by a motor) in its housing 507. Further, bearings can be included to facilitate motion of the pivot joint 508 relative to the pivot joint housing 507. The angular range of movement for the pivot join 508 may further be limited by a mechanical protrusion that functions as a stopper. Further, the pivot joint 508 can include a locking mechanism. The locking mechanism can be electronically or manually lockable, or both.

Figure 6A:
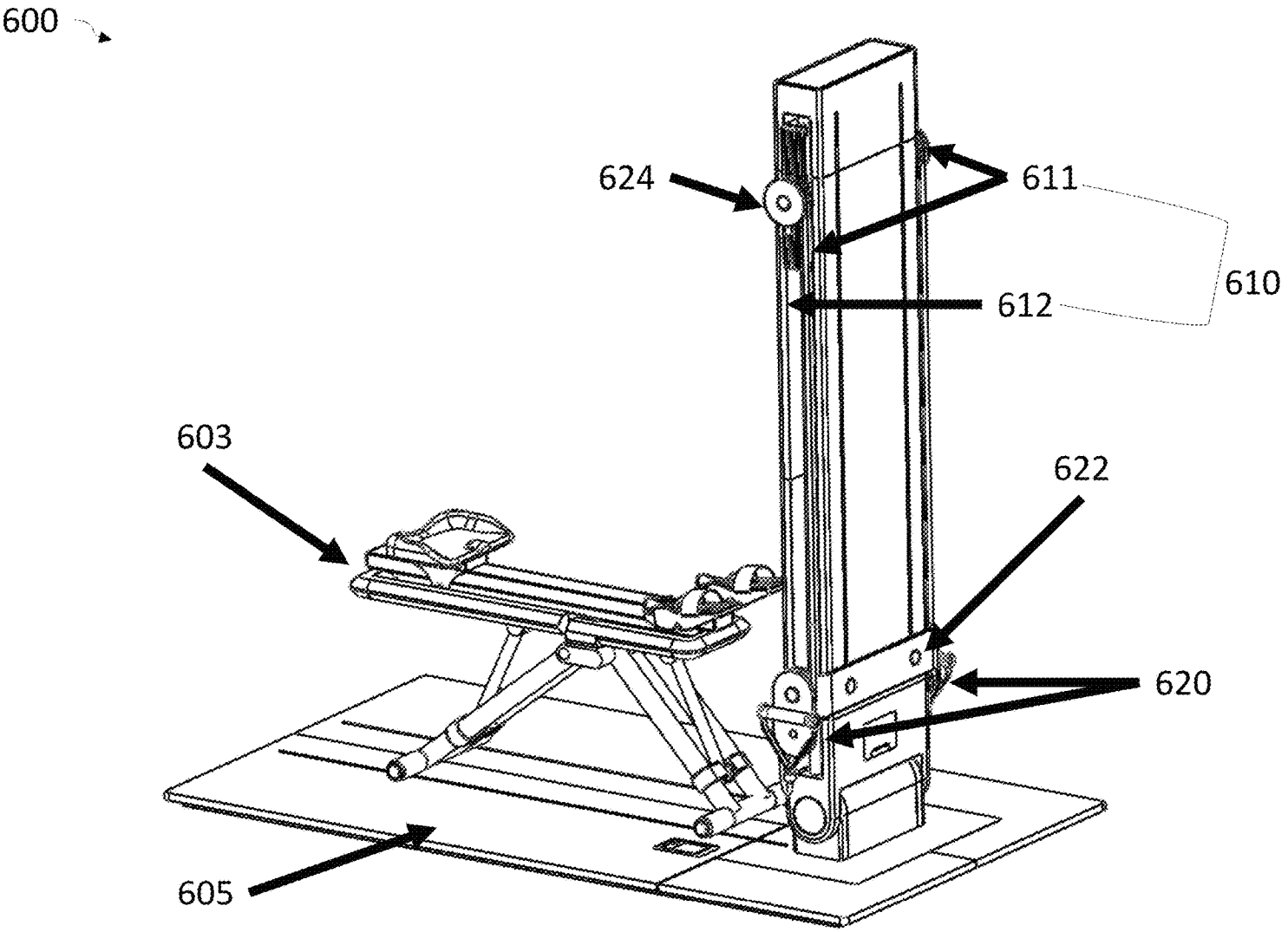
FIG. 6A illustrates a strength training system including a rope and pulley system and electric motors, according to one embodiment.

FIG. 6A illustrates a strength training system 600 including a rope and pulley system and electric motors, according to one embodiment. The system includes a base 605 (e.g., the base 105 illustrated in FIG. 1) and a bench 603. For example, the bench 603 can be used to facilitate rowing exercises (e.g., by allowing a user to slide or roll across the bench 603).

The system 600 further includes electric linear motors 610 (e.g., the linear motors 110 illustrated in FIG. 1), each of which includes a respective mover 611 and rotor 612 (e.g., a shaft). The system further includes pulleys 620. In an embodiment, as discussed further below with regard to FIG. 6B, the pulleys 620 guide a rope or cable as it moves with the linear motors as the user exercises. In an embodiment, the rope or cable is attached to rope attachment points 624. For example, the rope attachment points 624 can be attached to the movers 611 provide resistance as the user pulls on the ropes. In an embodiment, the pulleys 620 are attached to a vertically moving member 622 (e.g., a bar). The vertically moving member 622 can be used to move the pulleys 620 up and down, to allow for a variety of exercises (e.g., higher or lower rowing exercises or pull exercises) and a variety of user heights (e.g., to ensure comfort for a variety of users). In an embodiment, the linear motors 610 can facilitate independent motion of the ropes or cables 620 (e.g., to provide varied resistance the different sides of the system). Further, the use of pulleys 620 is merely one example. Any suitable structure can be used, including rollers, hooks, or a suitable low friction surface.

Figure 6B:
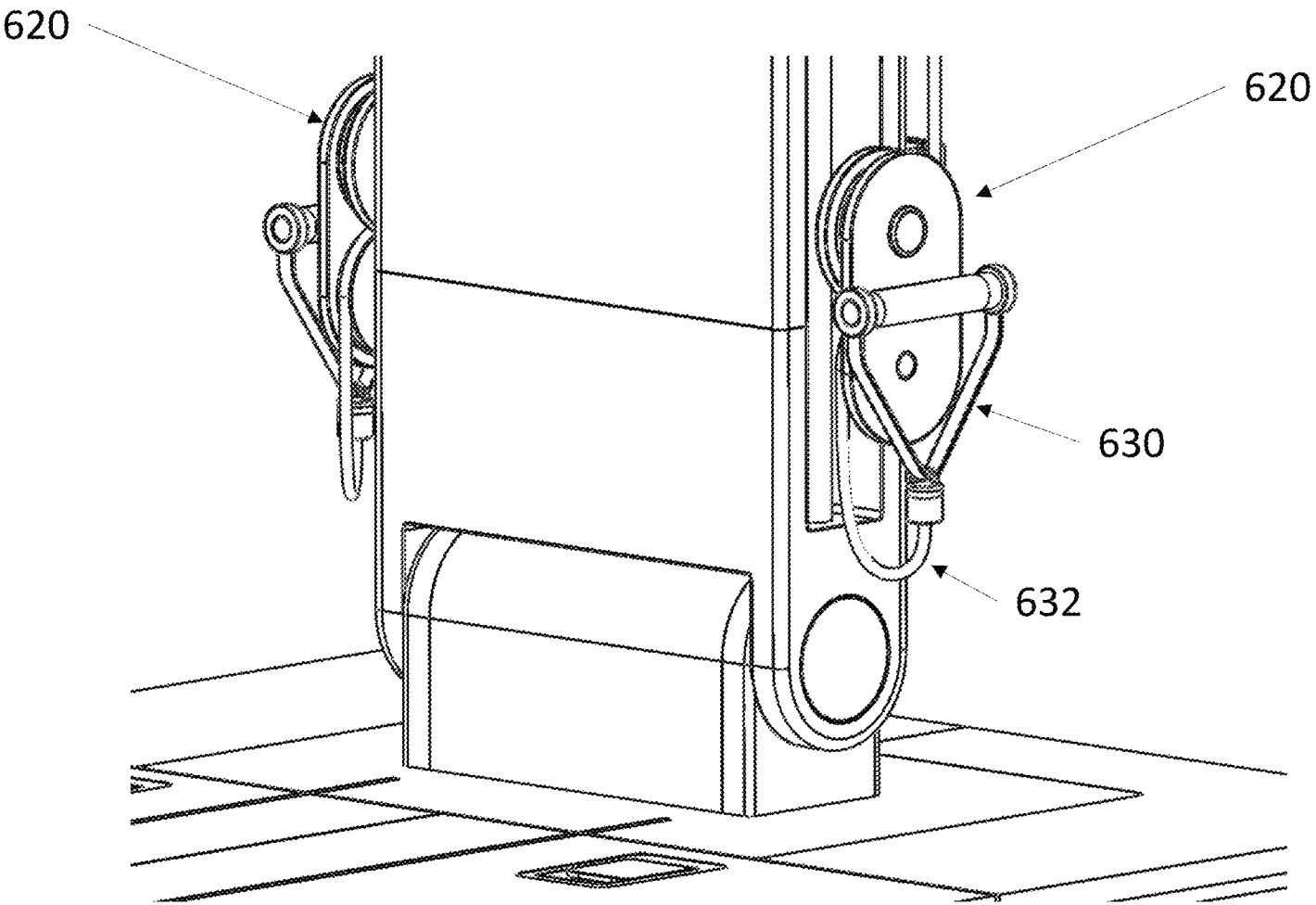
FIG. 6B further illustrates a rope and pulley system for a strength training system including electric motors, according to one embodiment.

FIG. 6B further illustrates a rope and pulley system for a strength training system including electric motors, according to one embodiment. In an embodiment, a rope or cable 632 is attached to a handle 630. The handle 630 can be any suitable exercise attachment, including handles for a rowing exercise, a straight bar, curved bar, a cable, or a rope. As discussed above, the cable or rope 632 moves within the pulley 620 to allow for a user to exercise by pulling on the handle. In an embodiment, the pulleys 620 are double pulleys (e.g., in which the cable or rope 632 passes between two pulleys). This can guide the cable or rope 632 and keep the cable or rope 632 from coming off the pulley 620 as the user changes the direction of force on the handle 630). Alternatively, the pulleys 620 can be single pulleys (e.g., in which the cable or rope 632 passes across one pulley).

Figure 6C:
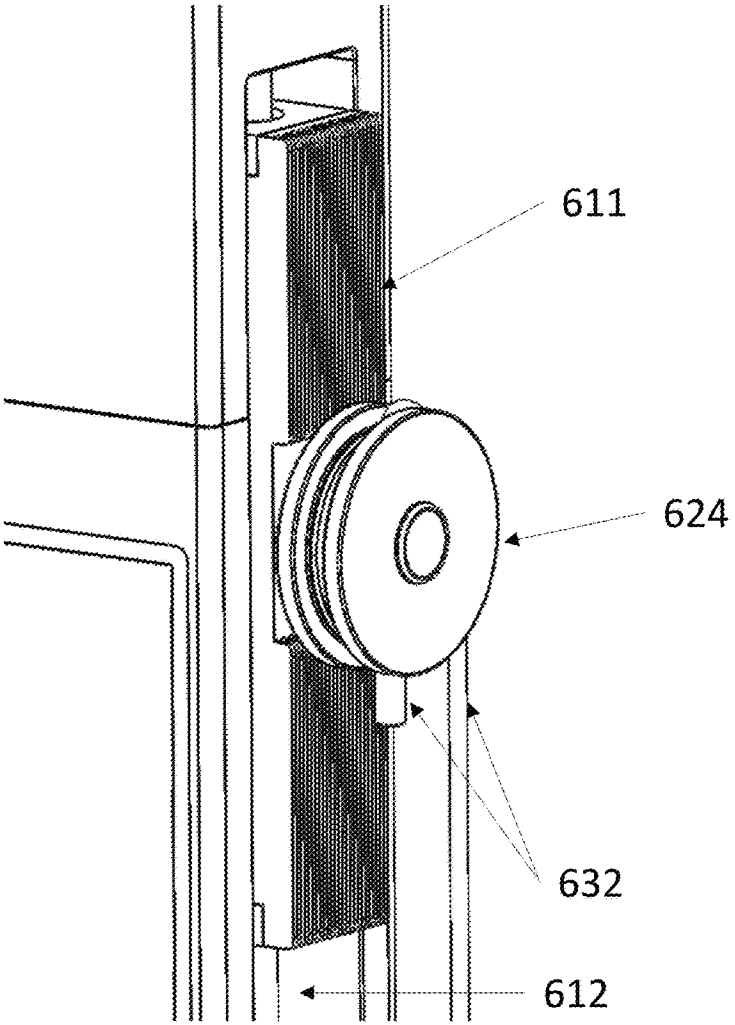
FIG. 6C further illustrates a rope and electric motor for a strength training system including electric motors, according to one embodiment.

FIG. 6C further illustrates a rope and electric motor for a strength training system including electric motors, according to one embodiment. A rope 632 is attached to a rope attachment point 624. In an embodiment, the rope attachment point is attached to a mover 611. The mover 611 moves up and down the rotor 612 (e.g., a shaft) as the user pulls handles attached to the rope 632. In an embodiment, the rope attachment point is fixed to the mover 611 (e.g., a hook) and acts to attach the rope 632 to the mover 611. Alternatively, the rope attachment point 624 could rotate (e.g., the rope attachment point 624 could itself be a pulley to assist in winding or storing the rope 632).

Figure 6D:
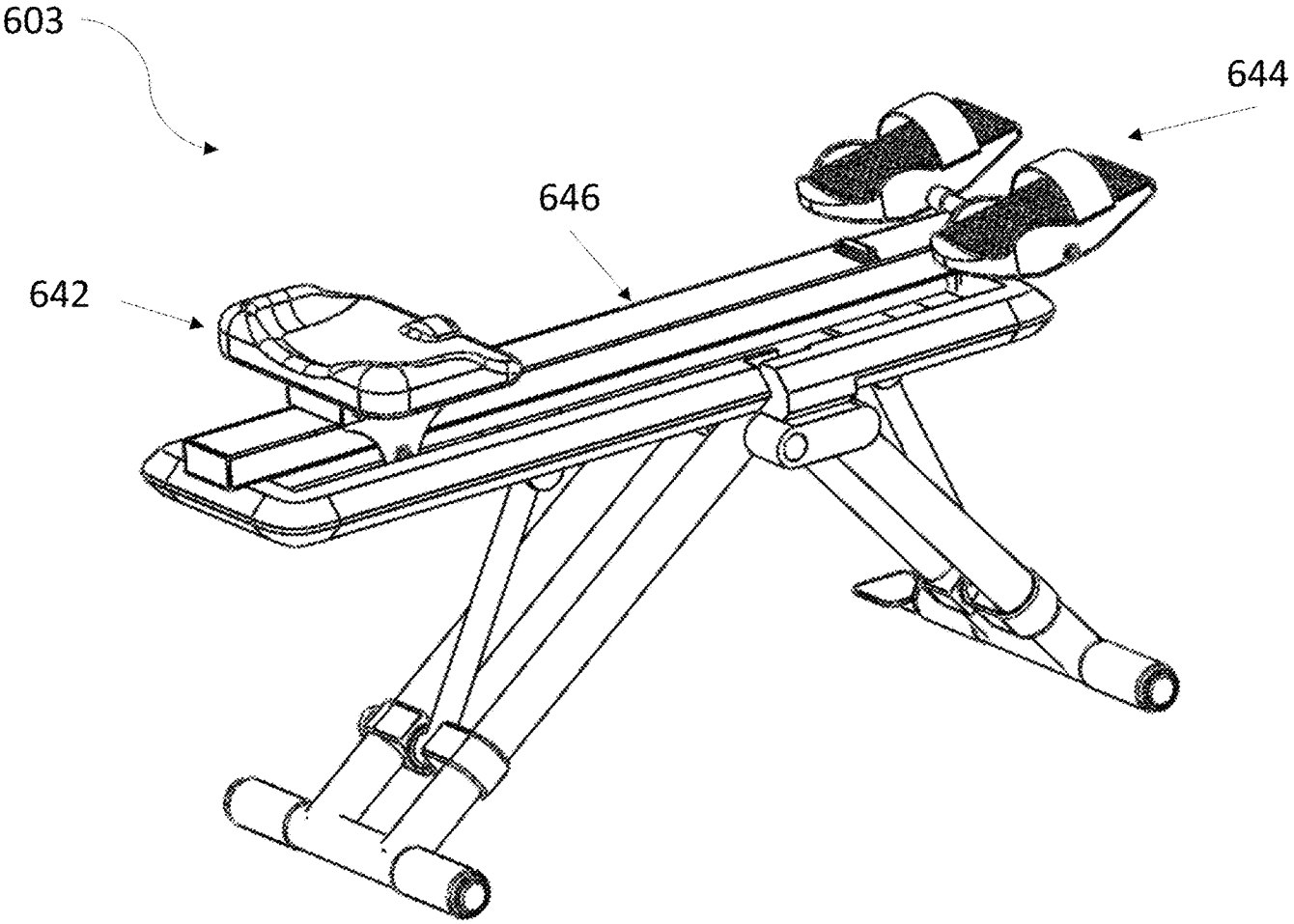
FIG. 6D illustrates a rowing bench for a strength training system including electric motors, according to one embodiment.

FIG. 6D illustrates a rowing bench for a strength training system including electric motors, according to one embodiment. In an embodiment, the bench 603 includes a seat 642 and footrests 644. In an embodiment, the seat 642 slides along the path 646 to facilitate rowing exercises in which a user's body moves (e.g., to provide cardiovascular exercise). Alternatively, the seat 642 is fixed to facilitate rowing exercises in which a user's body remains stationary (e.g., to provide strength training). For example, as illustrated in FIG. 6A, a user can hold onto handles attached to rope guided by the pulleys 620. The rope can be attached to the movers 611 in the electric motors 610. The user can both pull on the handles, and the movers 611 can provide a desired resistance. In one embodiment, the user moves as the seat 642 slides. In another embodiment, the user remains stationary while the seat 642 remains fixed.

Figure 7:
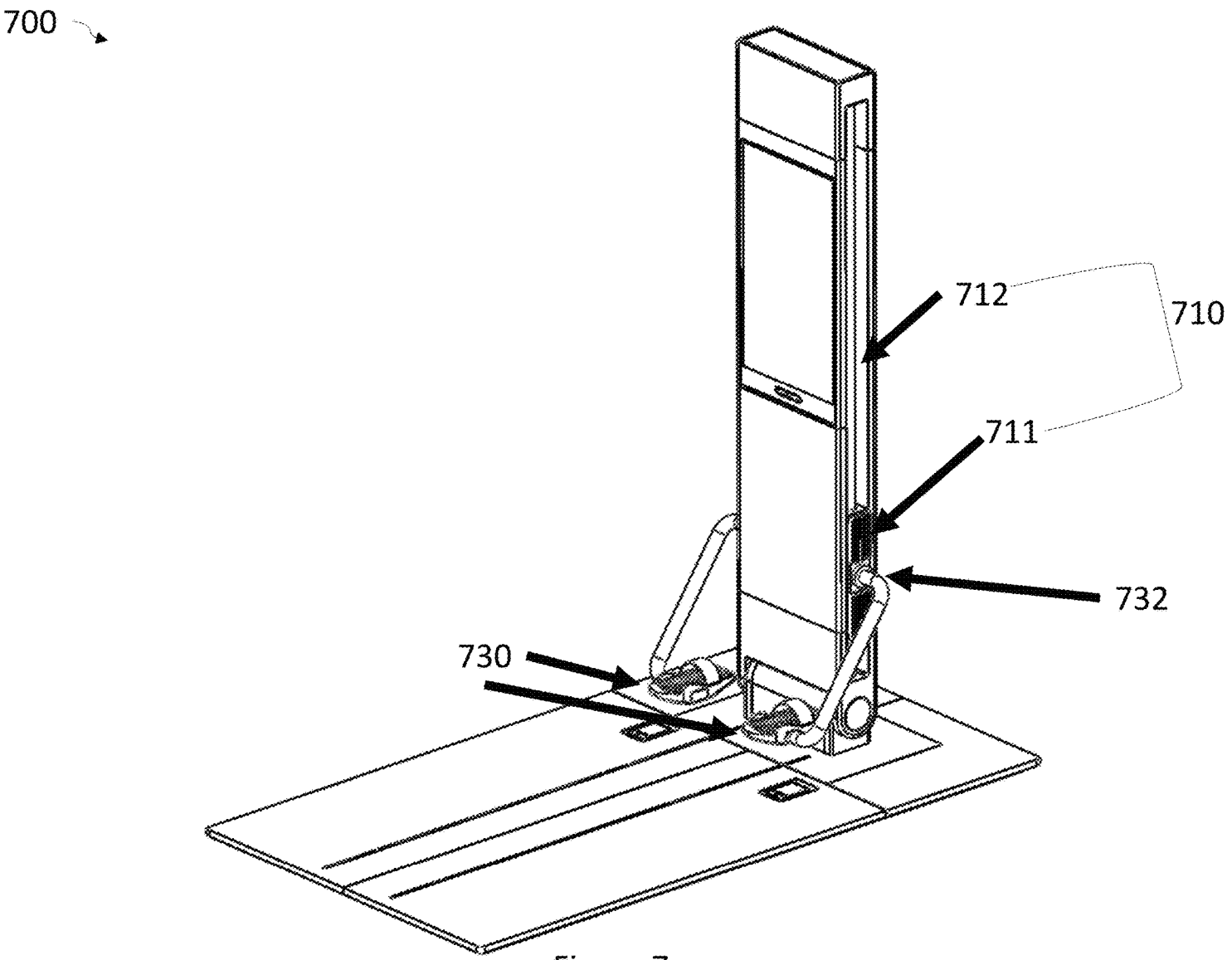
FIG. 7 illustrates a stepping machine for a strength training system including electric motors, according to one embodiment.

FIG. 7 illustrates a stepping machine for a strength training system 700 including electric motors, according to one embodiment. The system 700 includes electric linear motors 710 (e.g., the linear motors 110 illustrated in FIG. 1), which each include a mover 711 and a rotor 712. As discussed above, the mover 711 can travel up and down the rotor 712 (e.g., a motor shaft) on its respective side and can generate force in either direction of travel. This allows the linear motors 710 to generate force in either desired direction (e.g., with the mover 711 traveling up or down the rotor 712).

The system 700 further includes stepping platforms 730 (e.g., steps) to allow the user to use the system 700 as a stepping machine. For example, the steps 730 are connected to the movers 711 at the attachment points 732. The electric motors 710 can provide a desired resistance as the user steps up and down using the steps 730. In an embodiment, the attachment points 732 are fixed and do not pivot or rotate. Alternatively, the attachments points 732 can pivot or rotate to facilitate the user's exercise.

In an embodiment, the steps include grooves or other suitable techniques to avoid a user slipping as they move. Further, the steps 730 can include straps to hold a user's feet to the steps during the exercise. In an embodiment, the steps 730 are placed approximately shoulder distance apart, or in any other desired configuration.

Figure 8A:
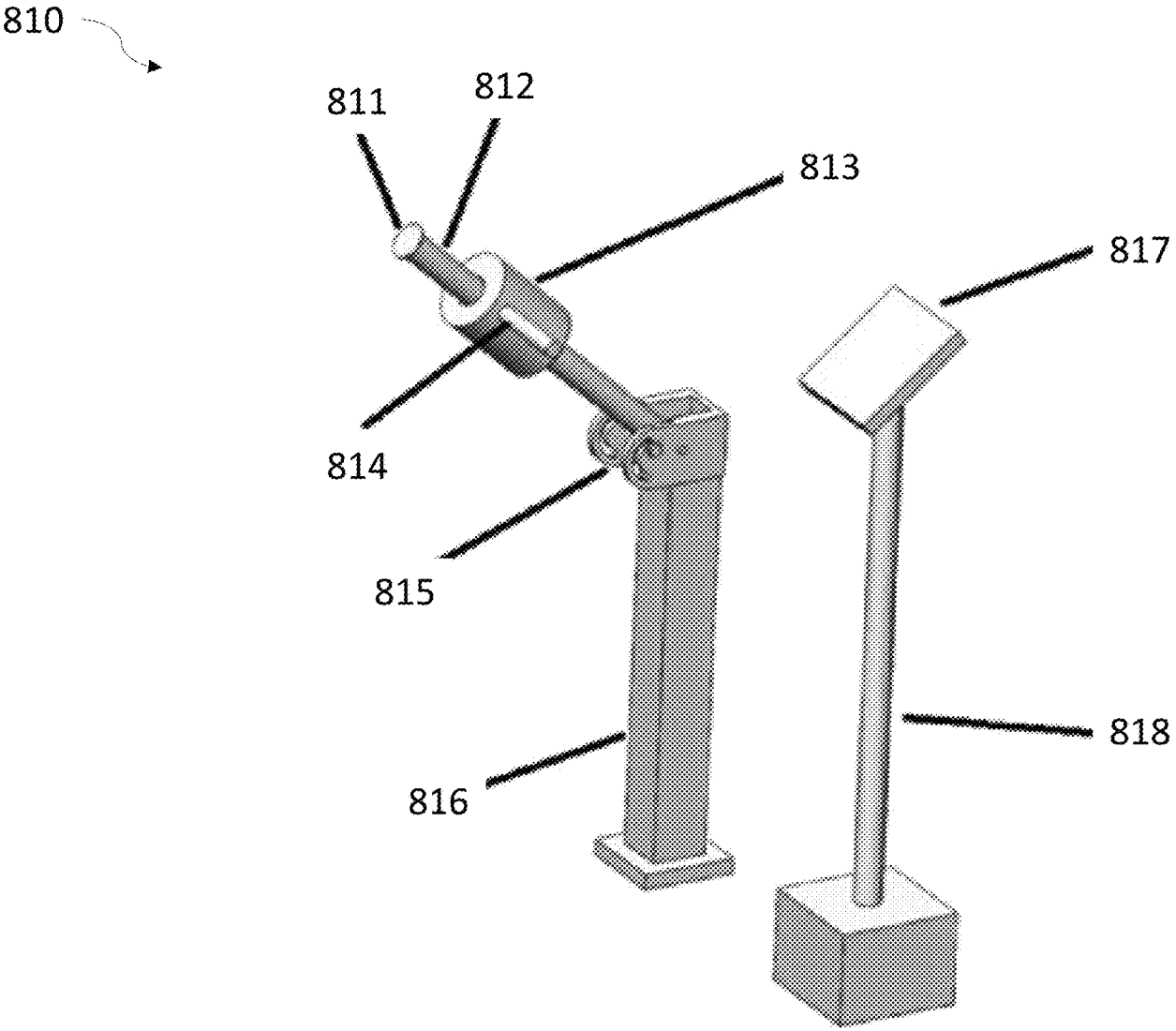
FIG. 8A illustrates a system 810 that uses a non-motorized pivot joint to change the configuration of a strength training machine, according to one embodiment.

FIG. 8A illustrates a system 810 that uses a non-motorized pivot joint to change the configuration of a strength training machine, according to one embodiment. With reference to FIG. 8A, the mover 813 in the linear electric motor is capable of traveling back and forth along the rotor 812 (e.g., the shaft). The motor mechanical stop 811 may prevent the mover 813 from being pulled/pushed off the rotor 812. The handle 814 that is attached to the mover 813 may be used by the user to grip. The handle 814 may also be rotated around the rotor 812 with the mover 813. The handle 814 may also be interchangeable, and may be swapped with cable pulls, cable hooks, bars, etc., to change the functionality of the device.

The entire top assembly, which includes the mover 813, the rotor 812, and the handle 814 are capable of pivoting around the pivot joint 815 and being locked into a selected position. This pivot feature may be utilized to change the configuration of the device from a vertical system to an inclined or a declined system. As an example, the device may be swapped from a bench press type configuration to a rowing machine type configuration, or an incline/decline type configuration (assuming another set of this device is used in conjunction for the other side).

The pivot joint 815 may also include a rotary motor (not shown), which may increase the degrees of freedom of the system. The stationary base 816 holds the device in place and optionally may enclose the motor drive modules and electronics. The optional user interface panel 817 may be similar to the user interface 106 of FIG. 1. The user interface panel 817 may allow selecting the simulated weight of the device as well as selecting various other configuration parameters, while displaying workout stats. The user interface panel 817 may either mount directly onto the stationary base 816 of the device or have its own stand 818, or be a configurable remote wired/wireless device.

Figure 8B:
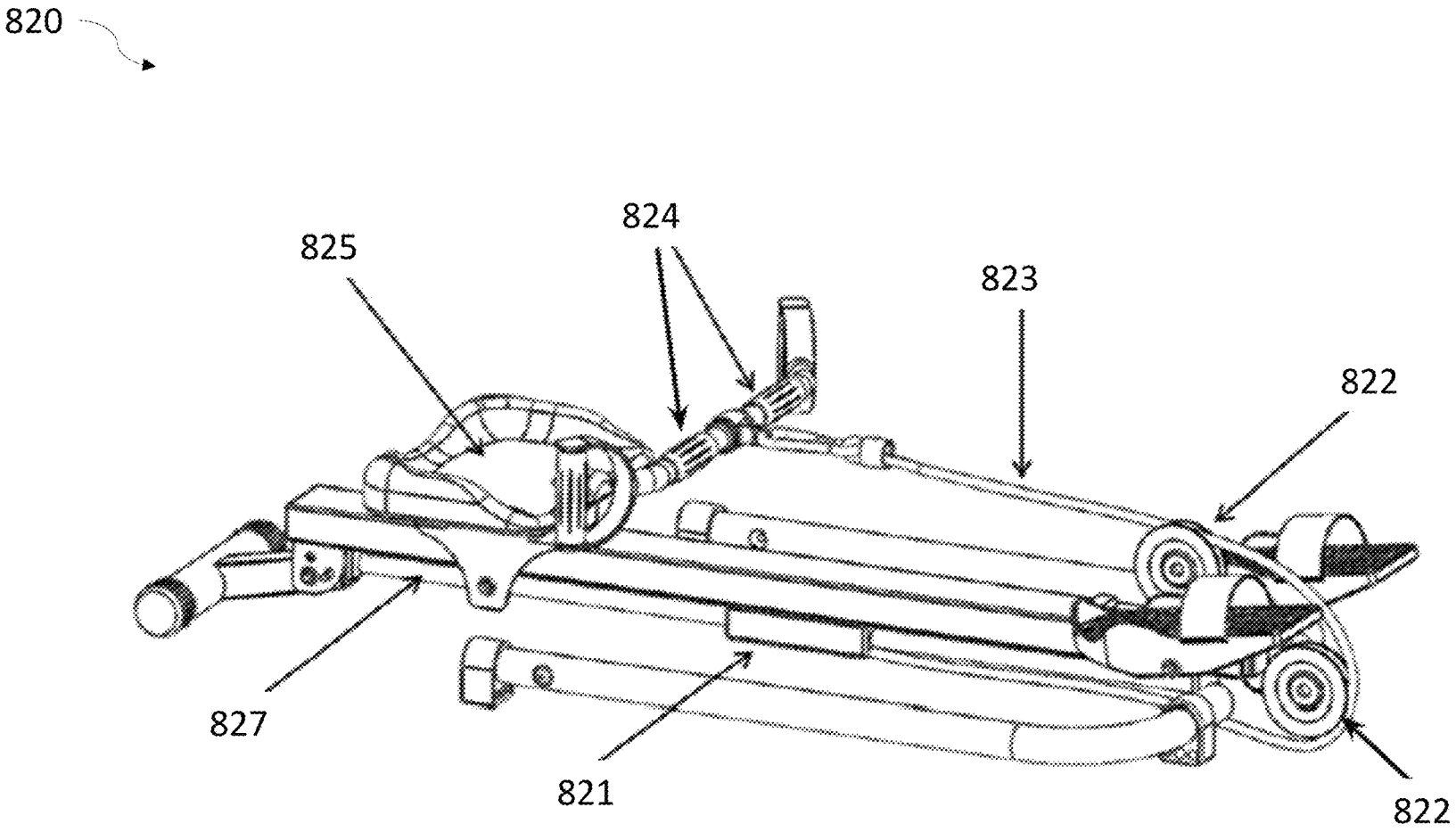
FIG. 8B illustrates as system that utilizes a mover for a linear motor or actuator attached to a cable and pulley system, according to one embodiment.

FIG. 8B illustrates as system 820 that utilizes a mover 821 for a linear motor or actuator attached to a cable and pulley system, according to one embodiment. The system 820 may be utilized as a rowing machine. The cable and pulley system may include one or more cables 823 and one or more pulleys 822. The movers 821 for the electric linear motor may move back and forth on the track 827 while opposing a force exerted by a user sitting on the seat 825 and pulling on the handle bars 824 that are attached to the cable and pulley system.

The system 820 may include display, control modules, motor drive, and/or power modules, that are not shown for simplicity. As illustrated, the system 820 shows the ability of using the motor-based capabilities of the present embodiments in a cable/pulley-based system that may operate similar to a traditional cable-based weight system. In the system 820, the motor force may be set by the user via a control panel or other communications medium, and may be controlled to simulate a precise smooth motion much like the gravitation pull on metal weights.

Figure 8C:
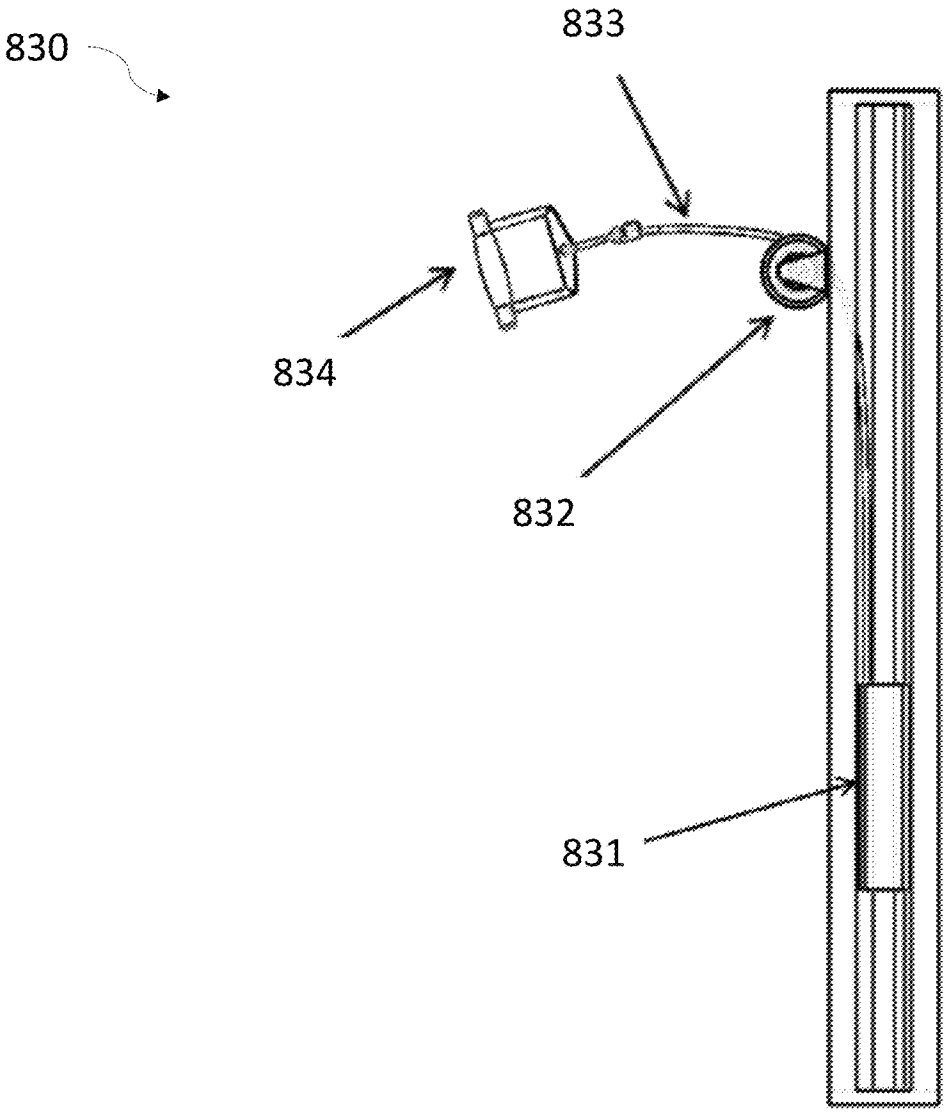
FIG. 8C further illustrates a system utilizes a belt or cable and pulley system with linear motors, according to one embodiment.

FIG. 8C further illustrates a system 830 utilizes a belt or cable and pulley system with linear motors, according to one embodiment. The system 830 illustrates a vertical standing system. The system 830 uses a mover 831 for a linear motor, attached to a cable or belt 833 and pulley 832 to provide a user with a strength training solution similar to a traditional cable-based weight machine. The user may be able to pull the handle 834 while the motor opposes the user force to a controlled force setpoint. The user may be able to set the weight simulation via a control panel (not shown) and monitor movement and metrics via a display (not shown). The configuration of the system 830 may also be expanded to allow the user to place a specified amount of weights on a mechanically coupled place (not shown) above the motor to increase the rated downward force of the motor and, therefore, allowing for a weaker motor to generate higher forces if needed.

One or more of the embodiments described above use electric motors (e.g., linear electric motors) to provide a user the ability to change the force and torque levels (which ultimately simulate weight) in either large or small granular steps across any part of an exercise movement, allowing for a wide range of weight simulation with the touch of a button. The user may be able to select weights from a negative value (force pulling against you) to a zero-weight option (no force, floating weight) to a positive force value (force pushing against you). In addition, an optional free-weight holder (e.g., as shown by the free-weight holders 104 of FIG. 1) may be used to load free-weights, which may be used in the event of power loss and/or to conserve energy or to further increase the range of provided force for the given system.

Further, or more of the embodiments described above may have a built-in safety system, which may provide the user with a variety of functional safety. In some embodiments, a user may be able to twist the bar or bars, press a button, or issue a voice command to immediately freeze and stop the motors in their current position, and bring them slowly and safely back to the home position. In addition, while one or more of the embodiments described above are in use, the intelligent control system may continuously monitor the motion and position of the motors (e.g., the position, direction, velocity, acceleration, etc.) to detect a sudden loss of force acting against it, which may indicate a user dropping the bars or the weights. In such an event, the control system may automatically freeze the motors in place to protect the user or bystanders from harm. One or more embodiments may also use various other sensor technologies such as, for example, and without limitations, touch sensors, displacement sensors, and vision sensors to provide additional safety as needed.

As described above, in an embodiment strength training systems may include one or more: electric motors (e.g., a rotary motor type, linear motor type, or a combination), actuators, controllers, wired or wireless communication network components, motor drives, touch screen user interfaces, stator bars or tracks, pivot points for stator tracks, sensors, twist stop features, twist increment weight features, twist decrement weight features, drop protection features, and push button to release bars features.

In an embodiment, using relatively minimalistic electric motors (e.g., linear electric motors) allows strength training systems to be much smaller and lighter than the typical strength training systems. A user may be able to move such a device and set it up with much less effort compared to moving large stacks of heavy weights, racks and benches. Further, strength training systems using these electric motors may be able to provide a large number of exercises (e.g., bench press, squat machine, rowing machine, stepping machine, bicep curl, etc.), while giving the user the ability to exercise a wide range of muscle groups and provide a wide range of motions.

Further, in an embodiment, a strength training system may also present the user with a customizable workout profile which may enable the systems to automatically increase or decrease the force based on the profile. In addition, as an option, when the motor is positioned in its home state, the user may be able to increase or decrease the force (e.g., the weight) by simply forward or reverse twisting the bar(s).

In an embodiment, simulated weight may then be displayed on a user interface display (e.g., the user interface 106 of FIG. 1). As described above, one or more embodiments can include a user interface panel mounted on a separate stand, or on the device itself. The interface panel may allow the user to connect to the Internet, change the device's settings, and connect to another device either wirelessly or wired. The systems described above may also be controlled via wired or wireless remote, voice command, or via a handheld device. The user may also be able to use the same features to download workout profiles available from personal trainers either remotely or online and follow available workout routines. The device may also keep track and record vital workout data in order to track the user's progress and statistics. Further, in an embodiment, the user interface can display guidance from a remote exercise instructor. For example, the user interface could display guidance from a human exercise instructor (e.g., live or recorded). As another example, the user interface could display guidance from an artificial exercise instructor. For example, a suitable machine learning (ML) or artificial intelligence (AI) technique could be used to generate and display an artificial exercise instructor.

The ability to load a customized workout profile also means that the workout profile may be defined such that the force is varied at specified intervals or positions of a given motion path. This enables the device to operate in a "safe zone" of motion and to ensure proper form during a strength training workout or a physical therapy routine. This feature may also be utilized in physical therapy applications to further assist patients by providing them with better form. If the device is web or remote enabled, a physical therapist may remotely control the force and motion track in real time thus eliminating the need to physically go into a physical therapist's office.

In an embodiment, a strength training device using electric motors as described above (e.g., linear electric motors) will be capable of providing a holding force equal and opposite to a user applied force to be used in specific applications. This force can be controlled to be dynamic, enabling the control arm to maintain its position while opposing the user's applied force. This configuration provides strength training capability to the user, which is especially useful in rehabilitation applications. The device can then continually measure and record the applied force at various points and monitor overall patient improvement.

In one or more of the embodiments described above (e.g., a bench press system) the device may utilize two independent bar handles instead of one bar. In these embodiments, the user may be able to lock both independent bar handles electrically (via control system) or mechanically, to be aligned with each other in order to simulate having a single bar (both bar handles move together). The user may, therefore, be able to either use each side independently or use both sides together (e.g., similar to using a barbell).

In addition to monitoring various metrics such as heart rates (based on sensors on bars/handles) and number of reps, one or more of the embodiments described above may provide the users with previously unattainable metrics during a strength training workout. Some of these metrics include the number of calories burnt, work performed, number of reps, change in weight, velocity or acceleration at various positions. The metrics information may be further processed to provide users with additional data points and profiles, which may be used for performance improvement.

In addition to being used as a pure strength training system, one or more embodiments described above may be used in devices designed for cardiovascular or endurance type exercises. As an example, the technology may be utilized in a rowing machine system (e.g., as illustrated above in relation to FIGS. 6A-D), to simulate a real world feel of oars in water and may be varied dynamically based on the real world variables such as water viscosity, currents, etc., or in a stepping machine (e.g., as illustrated above in relation to FIG. 7).

In the current disclosure, reference is made to various embodiments. However, the scope of the present disclosure is not limited to specific described embodiments. Instead, any combination of the described features and elements, whether related to different embodiments or not, is contemplated to implement and practice contemplated embodiments. Additionally, when elements of the embodiments are described in the form of "at least one of A and B," it will be understood that embodiments including element A exclusively, including element B exclusively, and including element A and B are each contemplated. Furthermore, although some embodiments disclosed herein may achieve advantages over other possible solutions or over the prior art, whether or not a particular advantage is achieved by a given embodiment is not limiting of the scope of the present disclosure. Thus, the aspects, features, embodiments and advantages disclosed herein are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

Computer program code for carrying out operations for embodiments of the present disclosure may be written in any combination of one or more programming languages, including an object oriented programming language such as Java, Smalltalk, C++ or the like and conventional procedural programming languages, such as the "C" programming language or similar programming languages. The program code may execute entirely on a user device, partly on a user device, as a stand-alone software package, partly on a user device and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

These computer program instructions may also be stored in a computer readable medium that can direct a computer, other programmable data processing apparatus, or other device to function in a particular manner, such that the instructions stored in the computer readable medium produce an article of manufacture including instructions which implement the function/act specified in the block(s) of the flowchart illustrations and/or block diagrams.

In view of the foregoing, the scope of the present disclosure is determined by the claims that follow.

We claim:

1. An exercise system, comprising:

a first electric linear motor, comprising a mover and a non-magnetic rotor;

a second electric linear motor, comprising a mover and a non-magnetic rotor;

a first bar coupled to the mover of the first electric linear motor;

a second bar coupled to the mover of the second electric linear motor;

wherein the first and second bars are configured to lock to each other and to unlock from each other, wherein the first and second electric linear motors are configured to move independently when the first and second bars are unlocked from each other, and wherein the first and second electric linear motors are configured to move together when the first and second bars are locked to each other, and a controller configured to control force generated by the first and second electric linear motors, wherein an amount of force required to move the first and second bars changes based on the force generated by the first and second electric linear motors.

2. The exercise system of claim 1, further comprising:

a stand encompassing the first and second electric linear motors;

a base; and a pivot joint coupling the base to the stand, wherein the pivot joint is configured to pivot to move the stand relative to the base.

3. The exercise system of claim 2, wherein the pivot joint comprises an electric motor, wherein the controller is further configured to control movements of the pivot joint by controlling the electric motor of the pivot joint.

4. The exercise system of claim 2, wherein the first and second electric linear motors are configured to provide vertical motion to the respective first and second bars, and wherein the pivot joint is configured to provide a tilting motion to the stand.

5. The exercise system of claim 1, further comprising:

a stand encompassing the first and second electric linear motors;

a base coupled to the stand; and one or more pressure sensors coupled to the base, wherein the controller is further configured to identify a location of an object in contact with the base using the pressure sensors.

6. The exercise system of claim 5, wherein the object in contact with the base comprises at least one of a user of the exercise system or an exercise bench relating to the exercise system.

7. The exercise system of claim 1, wherein the controller is further configured to determine an acceleration of each of the movers of the first and second electric linear motors based on positions of the movers of the first and second electric linear motors to control a movement of each respective mover.

8. The exercise system of claim 7, wherein determining the acceleration of each of the movers comprises determining a potentially unsafe acceleration, and wherein controlling the movement of each of the movers comprises slowing the respective mover.

9. The exercise system of claim 1, further comprising:

a stand encompassing the first and second electric linear motors;

a base coupled to the stand, the base comprising one or more base railings; and an exercise bench comprising one or more attachment points configured to attach to the one or more base railings of the base.

10. The exercise system of claim 1, further comprising:

a first free weight holder connected to an end of the first bar; and a second free weight holder connected to an end of the second bar; and wherein a force provided by the exercise system increases with addition of free weights to the first and second free weight holders.

11. The exercise system of claim 1, further comprising:

a first free weight holder connected to an end of the first bar; and a second free weight holder connected to an end of the second bar; and wherein the exercise system is configured to be used without electricity when free weights are added.

12. The exercise system of claim 1, wherein the rotors of the first and second electric linear motors are shafts, wherein the mover of the first electric linear motor encloses the shaft of the first electric linear motor to prevent items being caught in, or struck by, the rotor of the first electric linear motor, and wherein the mover of the second electric linear motor encloses the shaft of the second electric linear motor to prevent items being caught in, or struck by, the rotor of the second electric linear motor.

13. The exercise system of claim 1, wherein the rotors of the first and second electric linear motors are bars, wherein the mover of the first electric linear motor encloses the rotor of the first electric linear motor, wherein the mover of the second electric linear motor encloses the rotor of the second electric linear motor, and wherein the exercise system further comprises guiderails to guide the mover of the first electric linear motor to move along the rotor of the first electric linear motor and the mover of the second electric linear motor to move along the rotor of the second electric linear motor.

14. The exercise system of claim 1, wherein the controller is further configured to:

stop the first and second electric linear motors in response to detecting safe words.

15. The exercise system of claim 1, further comprising a plurality of dials, wherein at least one dial of the plurality of dials is disposed at an end of each of the first and second bars, the dials configured to receive user input to increase or decrease a resistance of the exercise device.

16. The exercise system of claim 1, wherein the controller is further configured to:

detect a sudden loss of force acting against the first and second electric linear motors; and freeze the electric linear motors in place.

17. The exercise system of claim 1, further comprising one or more buttons, wherein the controller is further configured to increase a force generated by each of the first and second electric motors impacting a force applied by each of the movers of the respective first and second electric linear motors to the respective first and second bars, or decrease the force generated by each of the first and second electric motors impacting the force applied by each of the movers, based on states of the one or more buttons.

18. The exercise system of claim 1, wherein the controller is further configured to:

calculate an acceleration of each of the movers based on the positions of the movers;

adjust the positions of each of the movers based on the respective acceleration in order to comply with an exercise program based on the acceleration; and halt each of the movers when the acceleration exceeds a threshold for the exercise program.

19. The exercise system of claim 1, further comprising:

a stand encompassing the first and second electric linear motors;

a base configured to attach to the stand, the base comprising a plurality of railings; and a bench comprising a plurality of attachment points configured to attach the bench to the railings of the base.

* * * * *